US007470063B2

(12) United States Patent
Leighton

(10) Patent No.: US 7,470,063 B2
(45) Date of Patent: Dec. 30, 2008

(54) RECLOSABLE BAGS HAVING A TEAR-OPEN STRING

(75) Inventor: Murray Edward Bruce Leighton, Yorkshire (GB)

(73) Assignee: Illinois Tool Works Inc., Glenview, IL (US)

( * ) Notice: Subject to any disclaimer, the term of this patent is extended or adjusted under 35 U.S.C. 154(b) by 163 days.

(21) Appl. No.: 10/522,825

(22) PCT Filed: Jul. 28, 2003

(86) PCT No.: PCT/GB03/03185

§ 371 (c)(1),
(2), (4) Date: Sep. 20, 2005

(87) PCT Pub. No.: WO2004/013007

PCT Pub. Date: Feb. 12, 2004

(65) Prior Publication Data

US 2006/0098902 A1 May 11, 2006

(30) Foreign Application Priority Data

Aug. 2, 2002 (GB) ..... 0217946.3

(51) Int. Cl.
*B65D 33/00* (2006.01)
*B65D 33/16* (2006.01)

(52) U.S. Cl. ..... 383/210.1; 383/205; 383/206; 383/210; 383/61.2

(58) Field of Classification Search ..... 383/5, 383/61.2, 63, 203–206, 210–211
See application file for complete search history.

(56) References Cited

U.S. PATENT DOCUMENTS

| | | | | |
|---|---|---|---|---|
| 2,293,952 | A * | 8/1942 | Stroop | 383/210 |
| 3,426,959 | A * | 2/1969 | Lemelson | 383/206 |
| 3,680,689 | A * | 8/1972 | Grundschober et al. | 206/222 |
| 5,186,543 | A | 2/1993 | Cochran | 383/203 |
| 5,330,269 | A * | 7/1994 | Kamada et al. | 383/210 |
| 5,375,930 | A | 12/1994 | Tani | 383/206 |
| 5,538,345 | A * | 7/1996 | Gotoh et al. | 383/210 |
| 5,609,420 | A | 3/1997 | Palmisano | 383/203 |
| 6,843,600 | B2 * | 1/2005 | Tilman et al. | 383/5 |

FOREIGN PATENT DOCUMENTS

| | | |
|---|---|---|
| EP | 0 951 989 | 10/1999 |
| FR | 1081608 | 12/1954 |
| FR | 2832698 | 5/2003 |

* cited by examiner

*Primary Examiner*—Jes F Pascua
(74) *Attorney, Agent, or Firm*—Woodcock Washburn LLP

(57) ABSTRACT

A reclosable bag (22) has a top seal (26) and a reclosable zipper (14). A tear string (16) passes through the top seal (26) and has a free end which can be grasped to open the top seal. The bag is made using cross-web technology with the tear strings (16) being attached to the lengths of zipper and the free ends of the strings being concertinaed in the top seal zone.

3 Claims, 2 Drawing Sheets

RECLOSABLE BAGS HAVING A TEAR-OPEN STRING

CROSS REFERENCE TO RELATED APPLICATIONS

This is the national phase in the United States of International patent application PCT/GB2003/003185, filed Jul. 28, 2003, which claims priority to United Kingdom Patent Application 0217946.3, filed Aug. 2, 2002; each of which is incorporated herein by reference.

BACKGROUND

This invention relates generally to reclosable bags and like containers, and is particularly concerned with reclosable bags which incorporate a zipper, i.e. male and female profiled elements which are engageable and separable in order to close and open the bag.

The invention is particularly applicable to reclosable bags which have the zipper applied using cross-web technology.

The invention is also concerned with methods of manufacturing reclosable bags and like containers which incorporate cross-web zippers.

In the manufacture of reclosable bags which incorporate both a zipper and a top seal, the consumer may find it difficult to open the top seal to gain access to the reclosable zipper. It is therefore an object of the present invention to provide a reclosable bag or like container in which the opening of the top seal by the consumer is facilitated.

SUMMARY

Broadly in accordance with the present invention this is achieved by providing the reclosable bag with an elongate tear element, preferably a strip, tape or string which protrudes from the finished bag and which can be grasped and pulled by the consumer to open the top seal and enable access to be gained to the reclosable zipper.

In a preferred embodiment of the invention the tear element, is attached to the zipper, for example by a peel seal material, and extends through the completed top seal to protrude from the top of the bag.

The bag can be manufactured by attaching to each zipper which is applied to the film a length of elongate tear element, preferably a strip, tape or string to one of the profile members of the zipper, and attaching a tail of strip, tape or string to the film material in an orientation which will cause it to lie within the intended top seal area. Then, when the top edge of the completed bag is severed to separate it from the adjacent bag, a short length of tear element will be left protruding.

Preferably, when the tear element is attached to the film it is concertinaed, so that when the completed bag is detached this will ensure that a length of the tear element is made available to be grasped.

BRIEF DESCRIPTION OF THE SEVERAL VIEWS OF THE DRAWINGS

In order that the invention may be more fully understood, one presently preferred embodiment in accordance with the invention will now be described by way of example and with reference to the accompanying drawings, in which.

DETAILED DESCRIPTION

Figure 1:
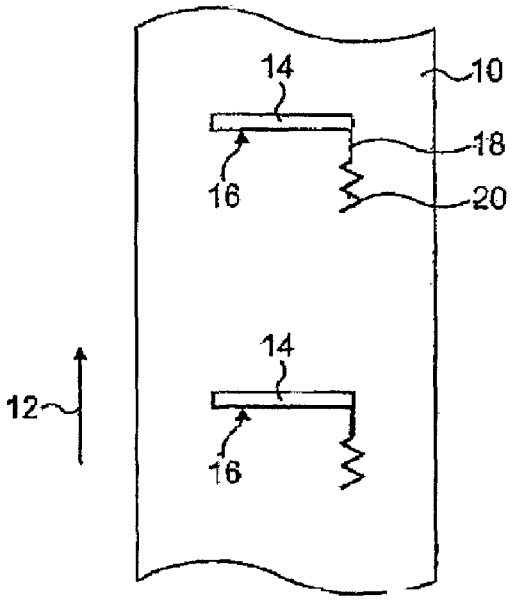
FIG. 1 is a schematic illustration of the application of zipper strips and tear strings to a film.

Referring first to FIG. 1, there is shown a film or web 10 of plastics material which travels in the direction indicated by arrow 12. Zippers 14 are applied to the film at regularly spaced intervals, for example using appropriate cross-web techniques. Each zipper 14 comprises male and female profile elements which are interengageable one with the other. Either before the zipper is applied to the film, or at the same time as the zipper is applied to the film, a length of tear string 16 is attached to the zipper. The tear string 16 is attached to the zipper along the full length of the zipper, and at one end has a tail 18 extending beyond the end of the zipper. This tail 18 of string 16 is attached directly to the film 10 so as to lie generally in the direction of movement of the film and extending towards the area of the film at which the top seal of the bag will be made. The tail 18 of string 16 is concertinaed over a part of its length as indicated at 20, at the approximate position where the completed bag will be severed from the adjacent bag.

The tear string 16, which may also be a strip or tape, can consist for example of a strong plastics material, such as nylon or PET, preferably coated with a peel seal material for reasons which will become apparent hereinafter.

Figure 2:
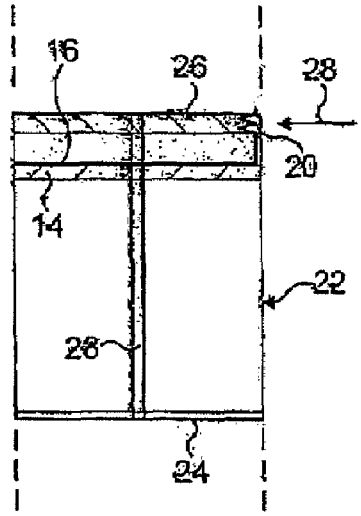
FIG. 2 is a schematic illustration of a completed bag prior to its severance from the adjacent bag.

FIG. 2 shows a completed bag 22 having a bottom seal 24, a top seal 26 and a back seal 28. As can be seen from FIG. 2, the tear string 16 is positioned to lie on the side of the zipper 14 which faces towards the top seal 26. The concertinaed portion 20 of the tear string is trapped within the top seal zone. In the manufacturing process, the completed bag 22 is severed from the adjacent bag by a cutting knife (not shown). The position of the knife cut is indicated by arrow 28.

Figure 3:
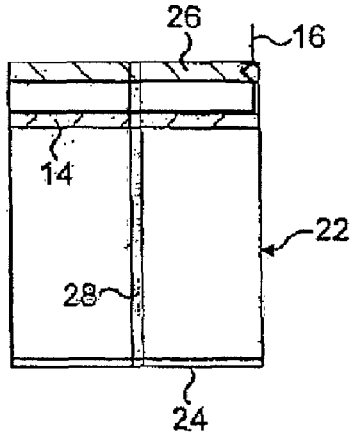
FIG. 3 is a schematic illustration of the severed bag with the protruding tear string.

FIG. 3 shows the completed bag after operation of the cutting knife. Here, the tear string 16 still has a portion which is trapped within the top seal 26. However, the concertinaed portion 20 of the string, when released by the cutting operation, is free to protrude from the top of the sealed bag, to enable it to be grasped.

Figure 4:
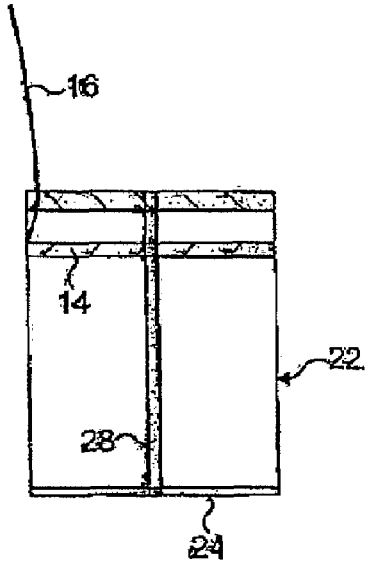
FIG. 4 is a schematic illustration of the bag after the tear string has been pulled to open the top seal.

If the protruding portion of the tear string 16 is grasped and pulled, then the top seal will be opened by the movement of the string and the length of string which lies alongside the zipper 14 will be peeled from the zipper, as illustrated in FIG. 4. The mouth of the bag 22 will then be open and the zipper 14 will be accessible.

The manufacture of bags described above may be carried out as part of the operating process of a form-fill-seal machine employing cross-web technology. In such a case, the bags will be filled during the manufacturing process. A typical form-fill-seal machine is shown in EP-A-0951989, the contents of which are incorporated herein by reference.

It will be appreciated that it is essential to the invention that there should be a portion of the tear strip, tape or string which projects from the top end of the completed bag, in order to provide something for the consumer to grasp and pull. However, the use of a concertinaed section, although a convenient way to achieve this, is not to be regarded as restricting the way in which this could be achieved.

Figure 5:
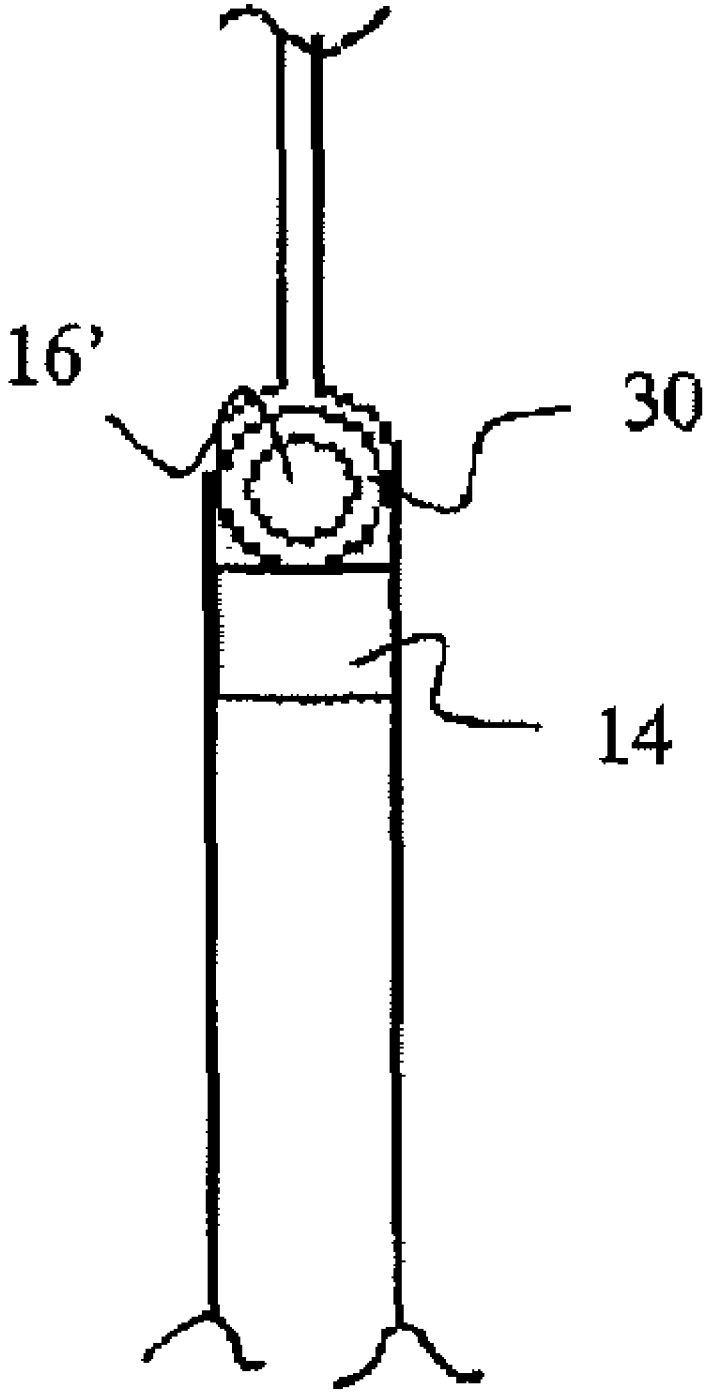
FIG. 5 is a partial cross sectional diagrammatic view depicting a tear element coated in a peel seal material and attached to a zipper.

FIG. 5 shows a partial cross sectional diagrammatic view depicting a tear element 16' coated with a peel seal material

30. As shown, the tear element 16' may be attached to the zipper 14 by the peel seal material 30. The tear element 16' may be a string tape or strip.

The invention claimed is:

1. A reclosable bag having a reclosable zipper and a top seal which is openable to gain access to the zipper, the bag having an elongate tear element attached to the zipper by a peel-seal material, the elongate tear element extending through the top seal to protrude from the top of the bag and so that it can be grasped and pulled to open the top seal and enable access to be gained to the reclosable zipper.

2. A bag according to claim 1, in which the tear element is coated with a peel seal material.

3. A bag according to claim 1, in which the tear element comprises a strip, tape or string.

* * * * *